US005219191A

United States Patent [19]

Wolter

[11] Patent Number: 5,219,191

[45] Date of Patent: Jun. 15, 1993

[54] EXTERNALLY ACTUATED ENCLOSURE LATCH ASSEMBLY

[75] Inventor: Richard A. Wolter, Cupertino, Calif.

[73] Assignee: Ampex Systems Corporation, Redwood City, Calif.

[21] Appl. No.: 867,256

[22] Filed: Apr. 10, 1992

[51] Int. Cl.[5] ..... E05C 1/16

[52] U.S. Cl. ..... 292/157; 292/DIG. 40; 292/174

[58] Field of Search ..... 292/156, 157, 162, 164, 292/174, 175, 161, 48, 183, 189, 302, DIG. 39, DIG. 40

[56] References Cited

U.S. PATENT DOCUMENTS

| | | | |
|---|---|---|---|
| 451,616 | 5/1891 | Egelston | 292/174 |
| 1,258,826 | 3/1918 | Thompson | 292/162 |
| 1,438,547 | 12/1922 | O'Connor | 292/161 |
| 1,485,815 | 3/1924 | Robertson | 292/162 X |
| 2,293,363 | 8/1942 | Schell | 292/302 X |
| 3,722,236 | 3/1973 | Zelenko | 292/161 X |

*Primary Examiner*—Richard E. Moore
*Attorney, Agent, or Firm*—John G. Mesaros

[57] ABSTRACT

An enclosure latch arrangement including at least one latch assembly for securing a first enclosure portion relative to a second enclosure portion by providing, on the inside of the first enclosure a stationary latch bracket member having a pair of spaced pin members on a common line. The second enclosure portion is provided with at least one latch bar assembly, which includes a spring biased latch actuator in slidable abutting relation with a latch bar secured within the enclosure. The latch actuator is barshaped and has a pair of spaced pawl openings formed in an edge thereof, spaced a distance equal to the spacing between the pin members, with the pawls including cam edges at the point of operative coaction with the pin members. The latch bar has provision for retaining one end of a compression spring member, and the latch actuator has provision for retaining the other end and further includes first and second slotted openings, through which fasteners are passed for engaging the latch bar to secure the parts in sliding abutting relation. The latch actuator has a bent portion at an end thereof to serve as a tool engaging surface for urging the latch actuator against the force of the spring bias. The enclosure is provided with a tool opening in general alignment with, or adjacent, the tool engaging surface for enabling insertion of a tool into the opening for actuating the latch actuator to enable separation of the enclosure portions. The latch assembly further includes a plunger oriented in a direction to bias the first and second enclosure portions apart, whereupon, on closing the separation or plunger spring is compressed, and, upon actuation of the latch actuator, the spring urges the portions apart.

7 Claims, 3 Drawing Sheets

EXTERNALLY ACTUATED ENCLOSURE LATCH ASSEMBLY

FIELD OF THE INVENTION

This invention relates to enclosure latches, and more particularly to an internal latch assembly actuated through an external opening in the enclosure assembly.

BACKGROUND OF THE INVENTION

Enclosures, such as cabinets and consoles ordinarily employ latches to secure the stationary part of the enclosure to the movable part thereof. For electronic equipment, plastic or metal enclosures are ordinarily employed. In either event, certain portions of enclosures for electronic equipment have so-called user-accessible portions, and other portions designated for service personnel only, with the latter portions of the enclosures ordinarily being labeled as having no user serviceable components.

Latches for electronic equipment enclosures, when externally mounted, may be unsightly or, as a minimum, detract from the otherwise aesthetic appearance of the enclosure. As a consequence, for aesthetic reasons, as well as functional reasons, it is preferable to provide latches for such enclosures which are either aesthetically pleasing in appearance, or concealed from ordinary view, such as in the rear of the enclosure. However, even when such latches are concealed from view by placement in the rear of the console or the enclosure, they do not necessarily preclude user entry at will. To further deter user entry, oftentimes such latches require special keys or locks.

In any event, such requirements impose additional design considerations, as a minimum, and at worst, additional cost in fabrication or for fasteners.

In accordance with an aspect of the invention, a concealed, economically fabricated, externally actuable latch mechanism is provided.

SUMMARY OF THE INVENTION

The foregoing and other objects of the invention are accomplished by providing a latch assembly which may be utilized individually for a pivoting cover or used as a pair of generally identical or mirror-imaged latch mechanisms or assemblies for securing a first enclosure portion relative to a second enclosure portion by providing, at opposite ends, on the inside of the first enclosure a stationary latch bracket member having first and second spaced pin members protruding therefrom on a common line. The second enclosure portion is provided, on the inside thereof, with first and second latch bar assemblies, each of which includes a spring biased latch actuator postioned in slidable abutting relation with a latch bar secured within the enclosure.

The latch actuator is generally metallic or rigid plastic material and generally bar-shaped and has first and second pawl openings formed in an edge thereof, with the openings spaced apart a distance generally equal to the spacing between the pin members of the latch bracket member, with the pawls including cam edges at the point of operative coaction with the pin members. The latch bar is formed of rigid material, such as sheet metal, generally right angularly configured, and has provision for retaining one end of a spring member. The latch actuator has like provision for retaining the other end of the compression spring member and further includes first and second slotted openings, through which fasteners are passed for engaging the latch bar to secure the parts in sliding abutting relation. The latch actuator includes, at one distal end thereof, a portion bent at generally right angles to serve as a tool engaging surface for urging the latch actuator against the force of the spring bias. The second portion of the enclosure is provided with a tool opening in general alignment with the tool engaging surface for enabling insertion of the tool into the opening for actuating the latch actuator to enable separation of the enclosure portions. Alternately, a tool opening may be provided in an adjacent portion of the enclosure for enabling latch actuator movement by pivoting of a tool. The latch assembly further includes a plunger, having assembled therein a second compression spring member oriented in a direction to bias the first and second enclosure portions apart, whereupon, on closing the plunger spring is compressed, and, upon actuation of the latch actuator, the plunger spring urges the portions apart.

Other objects, features and advantages of the invention will become apparent from a reading of the specification when taken in conjunction with the drawings, in which like reference numerals refer to like elements in the several views.

DESCRIPTION OF THE PREFERRED EMBODIMENT

Figure 1:
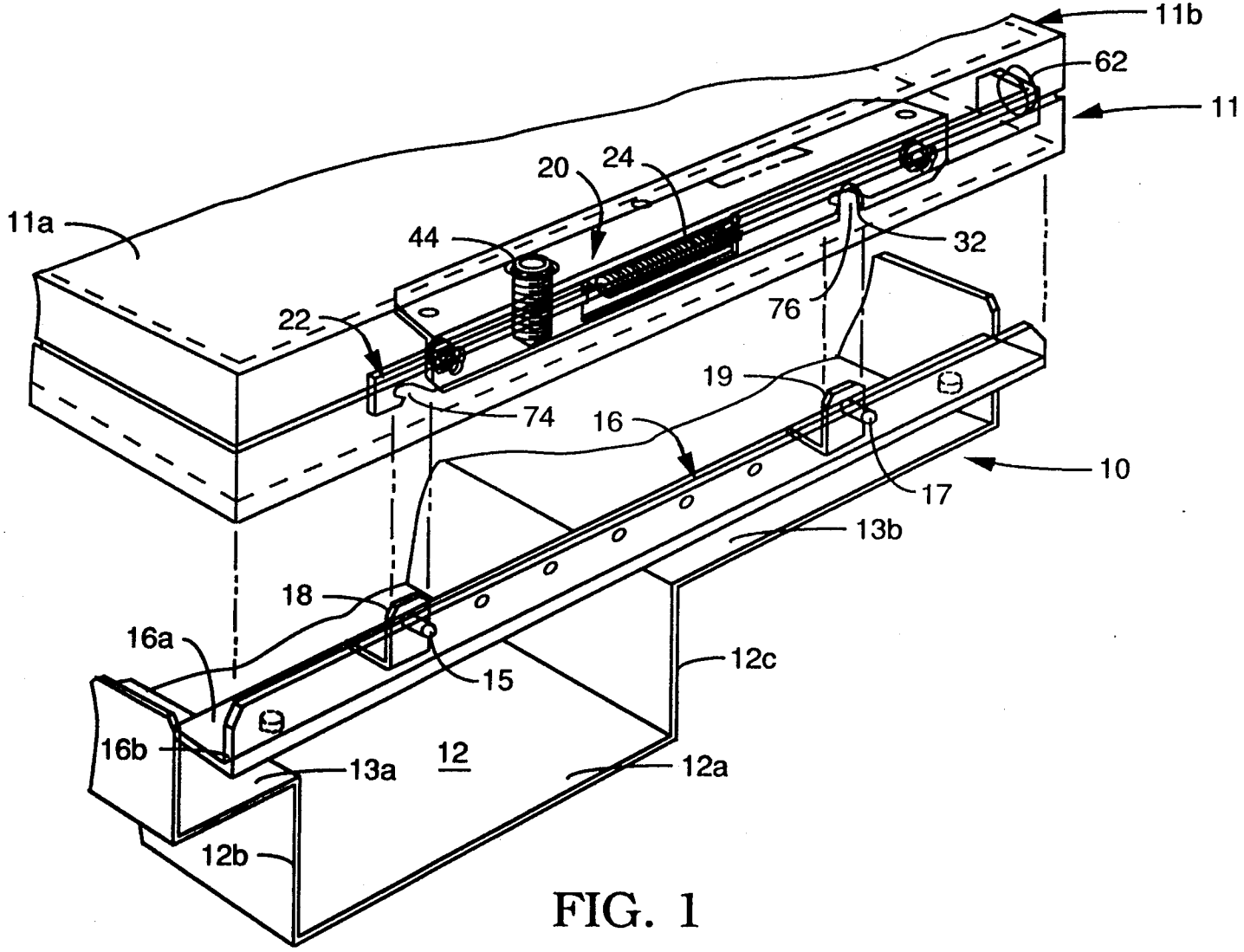
FIG. 1 is a perspective view of an externally actuable internally concealed enclosure latch assembly with the enclosure portions shown in phantom exploded relation.

Referring now to the drawings, and particularly to FIG. 1, there is shown an enclosure formed of a first portion or base 10 and a second portion or cover 11. Each of the enclosure portions 10 and 11 is formed of a suitable rigid material, such as sheet metal, plastic or the like, and configured as a box-like member which, when secured together form an electronic equipment enclosure. It is to be understood that, although the ensuing description proceeds with reference to an electronic equipment enclosure, the latch assembly to be described may be utilized with any boxlike enclosure formed of separable parts. However, due to its concealed nature, the assembly has particular application to an electronic equipment enclosure in which access to certain electrical components is to be limited.

The base 10 shown has the side panels thereof removed to illustrate interior details and attachments for the latch assembly. The base 10, which can be primarily mounted to surface 16*a*, includes a longitudinally extending trough shaped central portion 12, with a lower planar surface 12*a* configured for resting on a suitable surface, and upwardly extending sidewalls 12*b* and 12*c*. The upper edges of the sidewall are integrally formed with outwardly extending surfaces 13*a* and 13*b* which are coplanar and parallel to the surface 12*a*. A transversely extending latch bracket member 16 spans the trough and is physically attached to the coplanar surfaces 13*a*, 13*b*, such as by screws, spot weld or other suitable fastening means. The latch bracket member 16 is formed of suitable bent bar-shaped sheet metal to form an angle brace or support for the base 10 of the enclosure. The latch bracket member 16 has first and second mutually perpendicular flange portions 16*a* and 16*b*, the flange portion 16*a* being attached to the surfaces 13*a*, 13*b*.

First and second generally identically configured generally L-shaped angle pieces 18 and 19 are suitably secured in spaced aligned relation to the flange portion 16*a*, such as by spot welding, or secured with screws or by shear forming. The upwardly extending arms of the angle pieces 18 and 19 have metal rods or roll pins 15 and 17, respectively, attached thereto, such as by welding or brazing, or any other suitable means. The pins 15, 17 are generally identical in length and diameter, and are arranged in parallel relation in a direction perpendicular to the upwardly extending flange portion 16*b* of the latch bracket member 16.

The second enclosure member or cover 11 has an upper cover surface 11*a*, and a downwardly extending peripheral sidewall or skirt portion 11*b*. Assembled in proximate relation to one side of the skirt portion 11*b* is the latch mechanism including a latch bar generally designated 20, a latch actuator generally designated 22 and a compression spring member 24. A spring loaded plunger 44 is also provided as part of the assembly for facilitating separation of the movable portion of the enclosure from the other as will be described.

The latch bar 20 of the latch mechanism is formed of suitable rigid material, such as bent sheet metal (or formed of rigid plastic) and is right angularly configured in cross-section, with first and second flange portions 20*a* and 20*b*. The flange portion 20*b* is provided with a generally centrally located elongate slot 28 formed in the longitudinal direction of the flange portion 20*b*. Formed integrally with and extending in the direction of the slot 28 is a compression spring receiving finger 30, which is bent inwardly and offset relative to and parallel with the plane of the flange portion 20*b*. Formed in the lower edge of flange portion 20*b* is a slotted openign 32 of an inverted generally U-shaped configuration and having a width generally equal to or slightly greater than the diameter of the pins 15 and 17. Suitable fastener receiving apertures 34, 35 are formed in the flange portion 20*b* adjacent opposite ends thereof.

The upper flange portion 20*a* is provided with an enlarged aperture 38, with a threaded ferrule or clinch nut 40 pressed therein. A plunger assembly 44 is threadably fastened within the clinch nut 40 and adjusted to the desired depth, which is a depth sufficient for the spring loaded plunger extension 44*a* to extend below the lower edge of flange portion 20*b* so that the extension 44*a* engages and is depressed by a portion of the lower enclosure or base 16*a* when the enclosure portions are secured, one relative to the other. The flange portion 20*a* is further provided with three spaced latch mechanism mounting holes 46–48, which are preferably slots for permitting a certain amount of adjustment for optimum latching.

Figure 3:
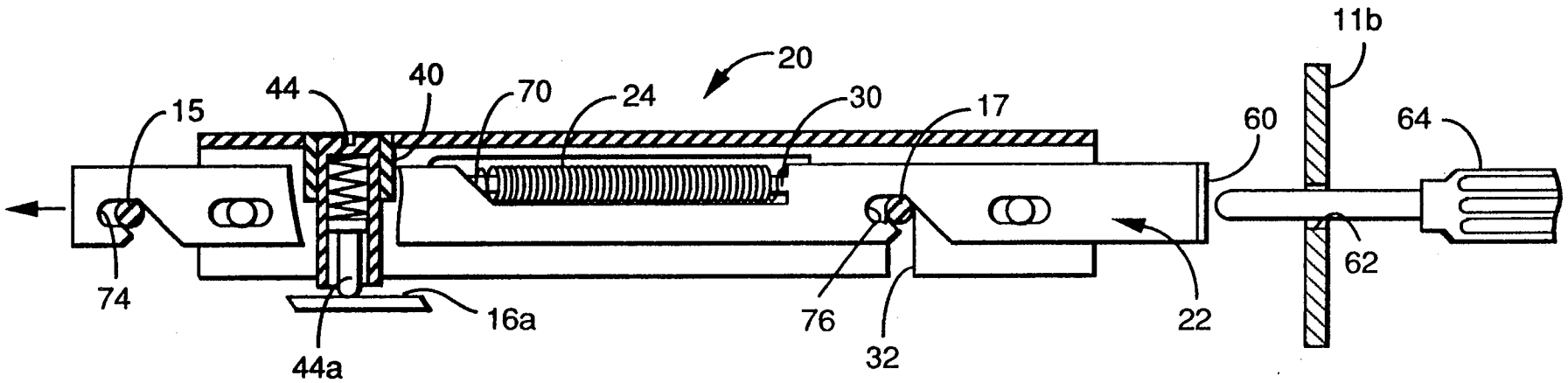
FIG. 3 is a side view, partially sectioned and partially broken away, of the assembled latch assembly of FIG. 1 shown with a tool in position for engagement with the latch actuator.

The latch actuator 22 is formed of generally rigid material, such as metal or rigid plastic, and is generally bar-shaped and has like provision for retaining the other end of a compression spring member 24. The latch actuator is provided with first and second slotted openings 52, 54, through which fasteners or shoulder rivets 53, 55, respectively, are passed for engaging the apertures 34, 35, respectively, in the latch bar 20 to secure the parts in sliding abutting relation. That is, the latch actuator 24 is in sliding abutting relation with the flange portion 20*b* of the latch bar 20. The latch actuator 22 includes, at one distal end thereof, a portion 60 bent at a generally right angle to the main body portion thereof and serves as a tool engaging surface for urging the latch actuator 22 against the force of the bias of the spring 24. The skirt portion 11*b* of the second portion or cover 11 of the enclosure is provided with a tool opening 62 (See FIGS. 1 and 3) in general alignment with the tool engaging surface 60 for enabling insertion of the tool 64 into the opening for actuating the latch actuator to enable separation of the enclosure portions. Any suitable tool, such as a pencil or screwdriver may be conveniently employed. Alternately, a tool opening may be provided in an adjacent portion of the enclosure for enabling latch actuator movement by pivoting of a tool.

Figure 2:
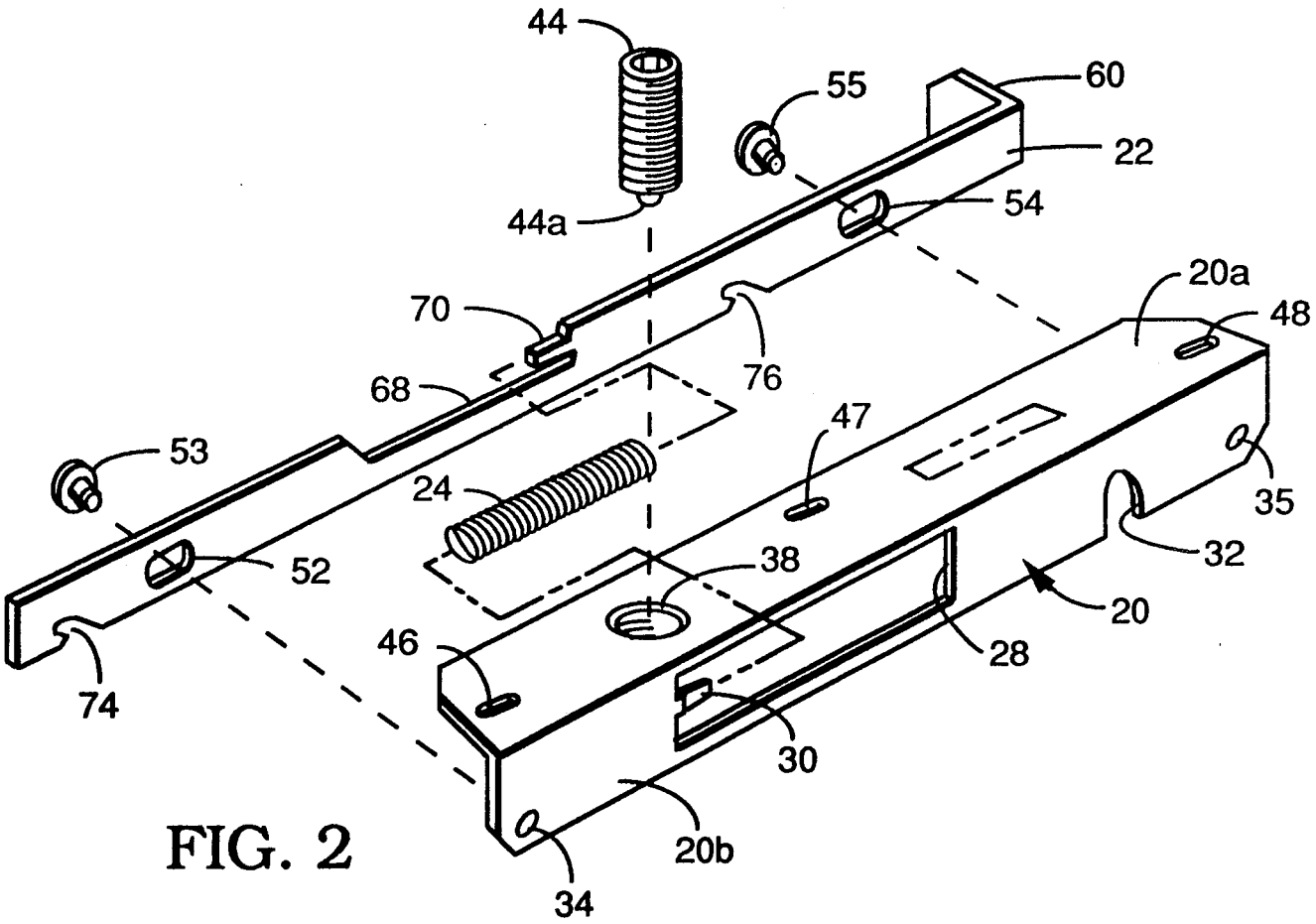
FIG. 2 is an exploded perspective view of the components of the latch assembly of FIG. 1.

The upper edge of the latch actuator 22 has a cutaway portion 68 with a finger 70 protruding into this cutaway section on a line generally parallel to the edge and in a direction opposite to the direction of the finger 30 of the latch bar 20, as assembled. The cutaway is dimensioned, in length and depth, to accommodate the compression spring 24 and, along with the offset of the finger 30, the fingers 30 and 70 are in general alignment with the fingers being received within the open opposite ends of the coil of the spring 24. The length of the spring 24 is sufficient to provide a bias to urge the latch actuator 22 to the right relative to the latch bar 20, as viewed in FIG. 2.

The lower edge of the latch actuator is provided with first and second pawl slots 74 and 76 spaced a distance generally equal to the spacing between the pins 15 and 17. With the latch actuator 22 assembled to latch bar 20, the pawl slot 76 is in generally aligned proximate relation with the slotted opening 32. Each of the pawl slots 74, 76 is configured as a hook shaped slotted opening, with the eye of the hook having a vertical dimension about equal to or slightly greater than the diameter of the pins 15, 17. The degree of lateral movement of the latch actuator provided by the slotted openings 52, 54 is sufficient to permit the hook or pawl edge to be urged aside after the pin enters the aligned pawl slot 76 and slotted opening 32, and thereafter the bias of the spring 24 urges the lower hook edge of the pawl opening beneath the pin to captively retain the pin 17 therein. Similarly, the pin 15 is retained within the pawl slot 74 by the hook edge thereof lying below the underside of pin 15.

As previously discussed, the latch assembly further includes a plunger 44, which assembled therein a second compression spring member oriented in a direction to bias the first and second enclosure portions, that is the cover 10 and base 12, apart, whereupon, on closing the plunger spring is compressed by coaction of the plunger extension 44*a* with the bracket member flange portion 16*a* (or some other suitable portion of the base 12), and, upon actuation of the latch actuator 22, the plunger spring urges the portions apart.

Although there has been shown one latch assembly, for a separable, as opposed to pivoting, cover/console enclosure, a second mirror-image latch assembly may be utilized, with the primary distinguishing features being a reverse angular orientation of the bent portions of the latch bar 20 and a reverse bend on the tool engaging surface 60 of the latch actuator 22. For a pivoting or hinged door on a console, it is to be understood that a single latch assembly 10 may be effectively utilized. Furthermore, although directional terms of upper, lower and the like have been employed, it is to be understood that the terms are with reference to the orientations of the respective components in the several views and are not intended to be limiting.

While there has been shown and described a preferred embodiment, it is to be understood that various other adaptations and modifications may be made within the spirit and scope of the invention.

What is claimed is:

1. A latch assembly for securing first and second enclosure portions, one relative to the other, said assembly comprising:

at least one pin means secured to one of said enclosure portions;

a latch bar secured to the other of said enclosure portions and having at least one slotted opening formed therein for receiving said at least one pin means therein;

a latch actuator having at least one pawl slot;

means for coupling said latch actuator in sliding abutting relation with said latch bar with said pawl slot in proximate relation with said slotted opening;

means for biasing said latch actuator in a first direction for captively securing said pin means within said slotted opening by means of the configuration of said pawl slot; and said latch actuator having a right angularly bent portion at one end thereof accessible for engagement by a separate tool inserted through an opening in said other enclosure portion for enabling operation of said latch actuator in a second direction opposite to said first direction against the force of its bias for releasing said at least one pin means from said opening for enabling separation of said enclosure portions.

2. The assembly according to claim 1 wherein said pin means are on a latch bracket secured to said one enclosure portion and said assembly further includes means on one of said latch bracket and said latch bar for urging against the other with said first and second enclosure portions secured to assist in separation of said enclosure portions on actuation of said latch actuator in said second direction.

3. The assembly according to claim 2 wherein said urging means includes spring-loaded plunger means.

4. The assembly according to claim 3 wherein said latch bar has first and second flange portions right angularly arranged with said latch actuator in sliding relation with one of said flange portions, the other of said flange portions including a threaded opening, and wherein said plunger means includes a body portion threadably engaging said threaded opening for enabling adjustment of said plunger.

5. The assembly according to claim 1 further including means for urging said first and second enclosure portions apart when secured to assist in separation of said enclosure portions on actuation of said latch actuator in said second direction.

6. The assembly according to claim 5 wherein said urging means are part of an adjustable spring-loaded plunger assembly.

7. The assembly according to claim 1 wherein said bent portion is positioned, relative to the opening in the other enclosure portion, in general alignment with the longitudinal axis of said latch actuator.

* * * * *